US007830338B2

(12) United States Patent
Lee

(10) Patent No.: US 7,830,338 B2
(45) Date of Patent: Nov. 9, 2010

(54) PLASMA DISPLAY AND DRIVING METHOD THEREOF

(75) Inventor: Joo-Yul Lee, Yongin-si (KR)

(73) Assignee: Samsung SDI Co., Ltd., Yongin (KR)

( * ) Notice: Subject to any disclaimer, the term of this patent is extended or adjusted under 35 U.S.C. 154(b) by 861 days.

(21) Appl. No.: 11/732,308

(22) Filed: Apr. 2, 2007

(65) Prior Publication Data

US 2008/0165091 A1 Jul. 10, 2008

(30) Foreign Application Priority Data

Jan. 8, 2007 (KR) ..... 10-2007-0002006

(51) Int. Cl.
*G09G 3/28* (2006.01)

(52) U.S. Cl. ..... 345/60; 345/63; 345/68

(58) Field of Classification Search ..... 345/41–94
See application file for complete search history.

(56) References Cited

U.S. PATENT DOCUMENTS

2005/0116890 A1* 6/2005 Lee et al. ..... 345/60
2005/0259042 A1* 11/2005 Lee ..... 345/63

FOREIGN PATENT DOCUMENTS

| | | | |
|---|---|---|---|
| JP | 2006-330663 | A | 12/2006 |
| KR | 10-2004-0029689 | A | 4/2004 |
| KR | 10-2004-0094092 | A | 11/2004 |
| KR | 10-2005-0036229 | A | 4/2005 |
| KR | 100586605 | | 5/2006 |

* cited by examiner

*Primary Examiner*—Sumati Lefkowitz
*Assistant Examiner*—Charles Hicks
(74) *Attorney, Agent, or Firm*—Knobbe Martens Olson & Bear LLP

(57) ABSTRACT

A driving circuit and method for driving a plasma display cell array using the circuit is disclosed. The driving circuit comprises a first transistor configured to drive the cells, a first driving sub-circuit configured to turn the first transistor on, and a second driving sub-circuit configured to turn the first transistor off when the voltage driven to the cells reaches a selected value.

14 Claims, 3 Drawing Sheets

PLASMA DISPLAY AND DRIVING METHOD THEREOF

CROSS-REFERENCE TO RELATED APPLICATION

This application claims priority to and the benefit of Korean Patent Application No. 10-2007-0002006 filed in the Korean Intellectual Property Office on Jan. 8, 2007, the entire content of which is incorporated herein by reference.

BACKGROUND

1. Field of the Invention

The field relates to a plasma display device and its driving method.

2. Description of the Related Technology

A plasma display device is a display device using a plasma display panel for displaying characters or images by using plasma generated from gas discharge. In the plasma display panel, a group of discharge cells are arranged to form a matrix of pixels.

In general, in the plasma display device, one image frame is divided into a plurality of subfields which are independently controlled, and gray scales are represented by a combination of weighted values of subfields. Light emitting cells and non-light emitting cells are selected by addressing operations during an address period of each subfield, and an image is displayed by sustain type gas discharges performed for the light emitting cells during a sustain period.

The discharges occur only when a voltage difference between two electrodes is set to be greater than a certain voltage level. The voltage level used for each electrode during the address period and the sustain period should be different. This means that a power source for supplying each voltage is required.

SUMMARY OF CERTAIN INVENTIVE ASPECTS

Certain inventive aspects provide a plasma display device and its driving method having advantages of reducing the number of power sources.

One aspect is a plasma display device including an electrode, a first transistor connected between the electrode and a power source configured to supply a first voltage, a first driver configured to change a voltage of the electrode by controlling a state of the first transistor, a second driver configured to cut off a path between the electrode and the power source when the voltage at the electrode is a second voltage during a first period, the second voltage being different from the first voltage, where the voltage of the electrode is substantially sustained at the level of the second voltage, and a second transistor connected between the electrode and the power source and configured to be turned on during a second period, the second period following the first period, where the first voltage is applied to the electrode when the second transistor is turned on.

Another aspect is a plasma display device including a plurality of electrodes, a first transistor connected between the plurality of electrodes and a power source configured to provide a first voltage, a first driver configured to gradually decrease a voltage of the plurality of electrodes during a reset period by controlling a state of the first transistor, first and second resistors connected in series between the plurality of electrodes and the power source, the first and second resistors having a contact therebetween, a second transistor connected between the plurality of electrodes and the power source, the second transistor being configured to apply the first voltage to the electrodes during an address period when turned on, and a third transistor configured to be turned on in response to a voltage of the contact of the first and second resistors, and configured to turn off the first transistor when turned on.

Another aspect is a method of driving a plasma display device including an electrode, the method including changing a voltage of the electrode during a first period, and disconnecting a path between the electrode and the power source during a second period after the voltage of the electrode is changed to a second voltage which is different from the first voltage, where the voltage of the electrode is substantially maintained at the second voltage.

DETAILED DESCRIPTION OF CERTAIN INVENTIVE EMBODIMENTS

In the following detailed description, only certain embodiments have been shown and described, simply by way of illustration. As those skilled in the art would realize, the described embodiments may be modified in various different ways, without departing from the spirit or scope of the present invention.

Accordingly, the drawings and description are to be regarded as illustrative in nature and not restrictive. Throughout this specification and the claims that follow, when it is described that an element is "connected" to another element, the element may be "directly connected" to the other element or "connected" to the other element through a third element.

Throughout the specification and the claims that follow, an expression of sustaining voltage includes a case where although a potential difference between two specific points changes with the lapse of time, the change is within a range allowable in designing or caused by a parasitic component that is disregarded in the usual practice in designing by a person in the art. In addition, compared with a discharge voltage, a threshold voltage of a semiconductor element (transistor or diode, etc.) is very low, so the threshold voltage is regarded as 0V and approximately processed. Thus, voltages applied to a node or an electrode by a power source includes voltages changed due to a threshold voltage or a parasitic component, etc., from voltage of the power source voltage.

The plasma display device and its driving method according to one embodiment will now be described.

Figure 1:
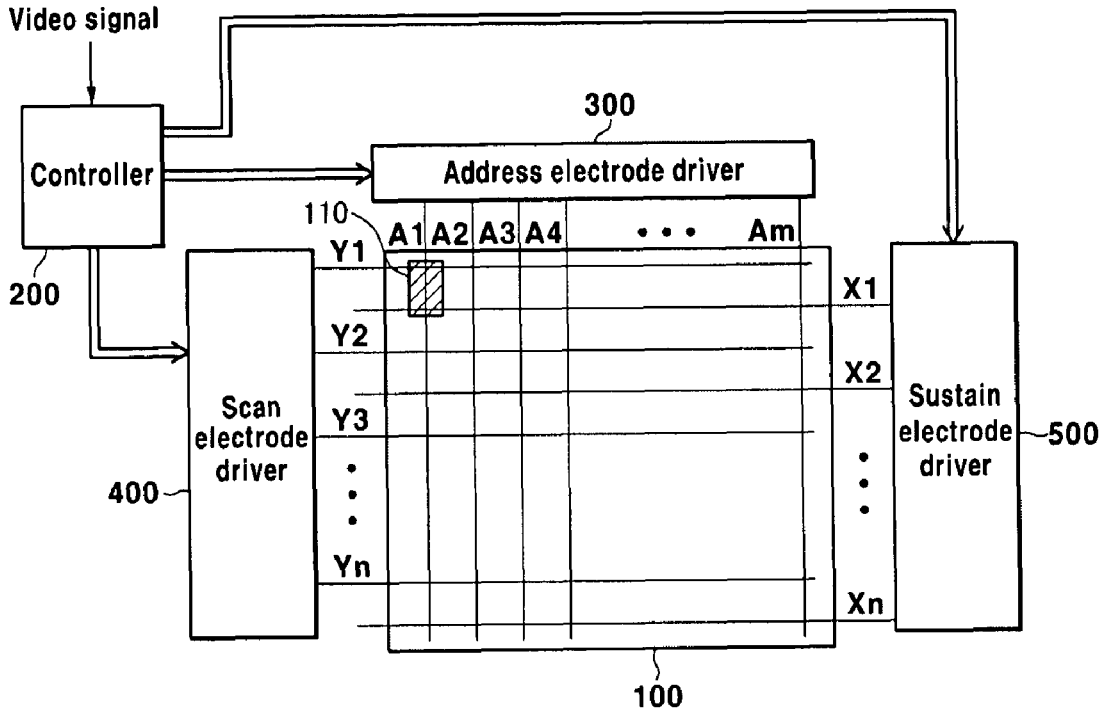
FIG. 1 is a drawing illustrating a plasma display device according to one embodiment.

FIG. 1 is a drawing illustrating a plasma display device according to one embodiment.

As shown in FIG. 1, the plasma display device according to one embodiment includes a plasma display panel 100, a controller 200, an address electrode driver 300, a scan electrode driver 400, and a sustain electrode driver 500.

The plasma display panel (PDP) 100 includes a plurality of address electrodes A1-Am (referred to as 'A electrodes' hereinafter) extending in a column direction, and a plurality of sustain electrodes X1~Xn (referred to as 'X electrodes' hereinafter) and a plurality of scan electrodes Y1~Yn (referred to as 'Y electrodes hereinafter) extending in a row direction, making pairs. In general, the X electrodes X1~Xn are formed to correspond to the respective Y electrodes Y1~Yn, and the X electrodes X1~Xn and the Y electrodes Y1~Yn perform a display operation during a sustain period in order to display an image. The Y electrodes Y1~Yn and the X electrodes X1~Xn are disposed to cross the A electrodes A1~Am. Discharge spaces present at each crossing of the A electrodes A1~Am and the X and Y electrodes X1~Xn and Y1~Yn form cells 110. The structure of the PDP 100 shows one example, and a panel with a different structure to which driving waveforms described hereinbelow can be applied can be also applicable in the described embodiments.

The controller 200 receives a video signal and outputs an A electrode driving control signal, an X electrode driving control signal, and a Y electrode driving control signal. The controller 200 drives a single frame by dividing it into a plurality of sub-fields, where each sub-field includes a reset period, an address period and a sustain period in terms of a temporal operational change.

The address electrode driver 300 receives the A electrode driving control signal from the controller 200 and applies a display data signal for selecting discharge cells to each A electrode.

The scan electrode driver 400 receives the Y electrode driving control signal from the controller 200 and applies a driving voltage to the Y electrodes.

The sustain electrode driver 500 receives the X electrode driving control signal from the controller 200 and applies a driving voltage to the X electrodes.

Figure 2:
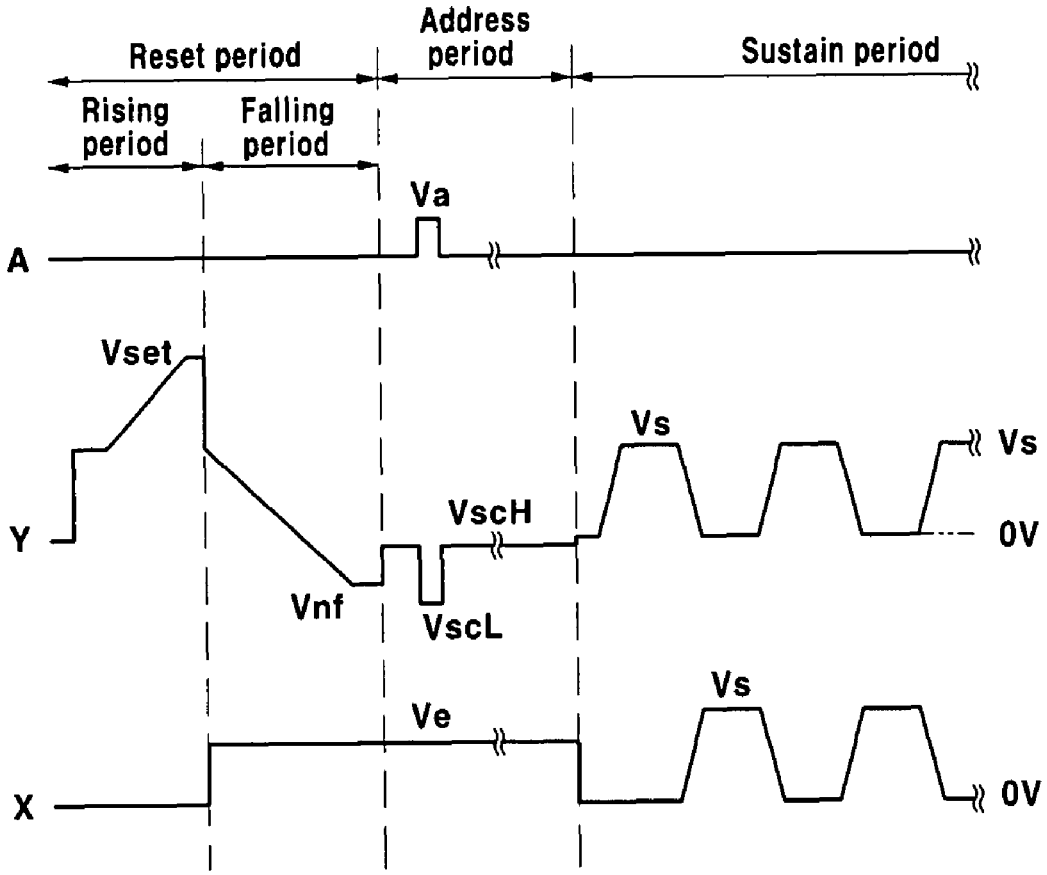
FIG. 2 is a drawing illustrating driving waveforms of the plasma display device according to one embodiment.

FIG. 2 is a drawing illustrating driving waveforms of the plasma display device according to one embodiment. Specifically, FIG. 2 shows only driving waveforms of one of a plurality of subfields of a single frame, namely, driving waveforms applied to the X, Y, and A electrodes that form a single discharge cell, for better understanding and ease of description.

As shown in FIG. 2, during a rising period of the reset period, the address electrode driver 300 and the sustain electrode driver 500 bias the A and X electrodes, respectively, to a reference voltage (0V in FIG. 2), respectively, and the scan electrode driver 400 gradually increases voltage of the Y electrodes from a voltage Vs to a voltage Vset. In FIG. 2, the voltage of the Y electrodes is shown to increase in a ramp pattern. While the voltage of the Y electrodes is increasing, a weak discharge occurs between the Y and X electrodes and between Y and A electrodes, forming negative (−) wall charges in the Y electrodes and positive (+) wall charges in the X and A electrodes.

During a falling period of the reset period, the sustain electrode driver 500 biases the X electrodes to a voltage Ve and the scan electrode driver 400 gradually decreases voltage of the Y electrodes from the voltage Vs to a voltage Vnf. In FIG. 2, the voltage of the Y electrodes is shown to be decreased in the ramp pattern. While the voltage of the Y electrodes is decreasing, a weak discharge occurs between the Y and X electrodes and between the Y and A electrodes, erasing the negative (−) wall charges formed in the Y electrodes and the positive (+) wall charges formed in the X and A electrodes. In general, a size of the voltage (Vnf−Ve) is set to be close to a discharge firing voltage between the Y and X electrodes. Accordingly, a wall voltage between the Y and X electrodes becomes almost 0V, so that cells where an address discharge does not occur during the address period can be prevented from being erroneously discharged (misfiring) during a sustain period.

In general, when the voltage Vnf is applied during a reset period, the sum of a wall voltage between the A and Y electrodes and the external voltage between the A and Y electrodes is determined by the discharge firing voltage Vfay between the A and Y electrodes. When 0V is applied to the A electrodes and the voltage VscL (=Vnf in some embodiments) voltage is applied to the Y electrodes, voltage Vfay is formed between the A and Y electrodes and a discharge could occur, but in this case, because a discharge delay time is longer than the width of the scan pulse and the address pulse, no discharge occurs. Meanwhile, when the voltage Va is applied to the A electrodes and the voltage VscL (=Vnf in some embodiments) is applied to the Y electrodes, a voltage difference higher than then Vfay is formed between the A and Y electrodes, reducing the discharge delay time so as to be smaller than the width of the scan pulse, so a discharge can occur. If the voltage VscL is set to be lower than the voltage Vnf, a voltage difference (VscL−Va) between the Y and A electrodes would increase to make an address occur desirably. In addition, the voltage Va can be lowered as much as the voltage difference VscL−Vnf. Thus, generally, during the address period, the voltage VscL is set to have a level equal to or lower than the voltage Vnf and the voltage Va is set to have a level higher than a reference voltage.

During the address period, the scan electrode driver 400 and the address electrode driver 300 apply scan pulses to the Y electrode (Y1 in FIG. 1) of a first row and at the same time apply address pulses to the A electrodes positioned at light emitting cells in the first row. Then, address discharges occur between the Y electrodes of the first row and the A electrodes to which the address pulses have been applied, forming negative (−) wall charges in the A and X electrodes.

Subsequently, while applying scan pulses to the Y electrodes (Y2 in FIG. 1) of a second row, the scan electrode driver 400 and the address electrode driver 300 apply address pulses to the A electrodes positioned at light emitting cells of the second row. Then, address discharges occur at cells formed by the A electrodes to which the address pulses have been applied and the Y electrodes of the second row, forming wall charges in the cells. Likewise, sequentially applying scan pulses to the Y electrodes of the other remaining rows, the scan electrode driver 400 and the address electrode driver 300 apply address pulses to the A electrodes positioned at light emitting cells to form wall charges.

Because the Y electrodes have a relatively high wall voltage over the X electrodes in the cells where the address discharges have occurred during the address period, namely, in the light emitting cells, the scan electrode driver 400 and the sustain electrode driver 500 apply sustain discharge pulses having the voltage Vs to the Y electrodes and a ground voltage to the X electrodes to cause sustain discharges between the Y and X electrodes. As a result, negative (−) wall charges are formed in the Y electrodes and positive (+) wall charges are formed in the X electrodes, so the Y electrodes have a relatively high voltage over the X electrodes.

Subsequently, the scan electrode driver 400 and the sustain electrode driver 500 apply the ground voltage to the Y electrodes and sustain discharge pulses having the voltage Vs to the X electrodes to cause sustain discharges between the Y and X electrodes. As a result, positive (+) wall charges are formed in the Y electrodes and negative (−) wall charges are formed in the X electrodes, making a condition to generate sustain discharges when sustain discharge pulses having the voltage Vs are applied to the Y electrodes. Thereafter, the process of applying the sustain discharge pulses having the voltage Vs to the Y electrodes and the process of applying the sustain discharge pulses having the voltage Vs to the X electrodes are repeatedly performed a number of times corresponding to a weight value indicated by corresponding subfields.

FIG. 2 illustrates that the sustain discharge pulses having the voltage Vs are alternately applied to the Y and X electrodes. But alternatively, sustain discharge pulses having the voltage Vs and a voltage −Vs alternately as a voltage difference of the Y and X electrodes can be applied to the Y electrodes and/or X electrodes. For example, in a state that the X electrodes are biased with the ground voltage, sustain discharge pulses having the voltage Vs and the voltage −Vs can be applied to the Y electrodes.

Also, FIG. 2 shows that after cells are initialized to non-light emitting states by erasing the wall charges in the cells during the reset period, cells are set as light emitting cells through the address discharges during the address period. But alternatively, after setting the cells to lighting states by writing the wall charges in the cells in the reset period or after the sustain period of the previous subfields, the cells can be set as non-light emitting cells through the address discharges during the address period.

Figure 3:
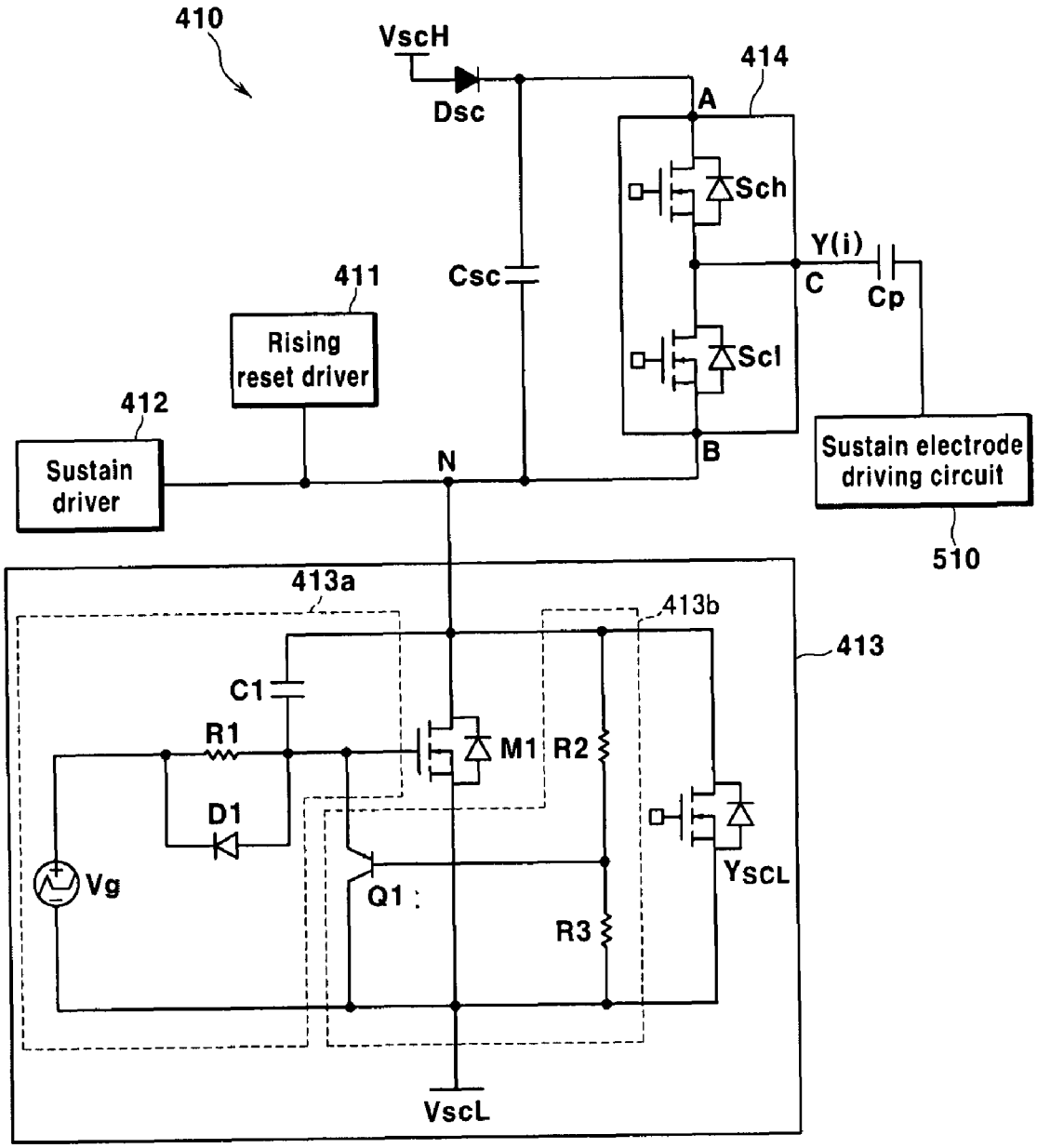
FIG. 3 is a drawing illustrating a scan electrode driving circuit according to one embodiment.

A driving circuit for implementing different levels of voltages with a single power source will now be described in detail with reference to FIG. 3. FIG. 3 shows an embodiment where the voltage Vnf may be applied to the Y electrodes during the reset period and the voltage VscL may be applied to the Y electrodes during the address period.

FIG. 3 is a drawing illustrating a scan electrode driving circuit according to one embodiment. The scan electrode driving circuit 410 can be formed in the scan electrode driver 400, and a sustain electrode driving circuit 510 connected with the X electrodes can be formed in the sustain electrode driver 500. For better understanding and ease of description, only a single Y electrode Yi is shown and a capacitive component formed by the single Y electrode and a single X electrode is shown as a panel capacitor Cp. It is assumed that the voltage Vs has been applied to the Y electrode before a falling ramp waveform is applied during the falling period.

As shown in FIG. 3, the scan driving circuit 410 according to some embodiments includes a rising reset driver 411, a sustain driver 412, a falling reset/scan driver 413, a scan circuit 41, a capacitor Csc, and a diode Dsc.

First, the scan circuit 414 includes first and second input terminals A and B, and an output terminal C connected with the Y electrode Yi, and selectively applies voltage of the first input terminal A and voltage of the second input terminal B to the corresponding Y electrode. Although FIG. 3 illustrates a single scan circuit 414 connected with the Y electrode Yi, the scan circuit 414 may actually be connected with the plurality of Y electrodes Y1~Yn.

Alternatively, a certain number of scan circuits 414 can be formed as a single scan integrated circuit IC, and a plurality of output terminals of the scan integrated circuit can be connected with a certain number of Y electrodes.

The scan circuit 414 includes transistors Sch and Scl. A source of the transistor Sch and a drain of the transistor Scl are connected with the Y electrode Y1 of the panel capacitor Cp. A drain of the transistor Sch is connected with the first input terminal A, a power source VscH for supplying a voltage VscH is connected with the first input terminal A through diode Dsc, a cathode of the diode Dsc whose anode is connected with the power source VscH is connected with the second input terminal B through capacitor Csc. A source of the transistor Scl is connected with the second input terminal B, and the second input terminal B is connected with a node N. A capacitor Csc is connected between the first and second input terminals A and B.

The falling reset/scan driver 413 is connected with the node N and includes transistors M1 and YscL and drivers 413*a* and 413*b*. The driver 413*a* includes a capacitor C1, a resistor R1, a diode D1, and a control signal voltage source Vg, and the driver 413*b* includes a transistor Q1, and resistors R2 and R3. A power source VscL for supplying a voltage VscL is connected with a source of the transistor M1 whose drain is connected with the node N. A second terminal of the capacitor C1 whose first terminal is connected with the drain of the transistor M1 is connected with a gate, a control terminal, of the transistor M1. One terminal of the resistor R1 and an anode of the diode D1 are connected with the second terminal of the capacitor C1, and a cathode of the diode D1 are connected with the other end of the resistor R1. The control signal voltage source Vg is connected between the other end of the resistor R1 and the power source VscL. The transistor M1 is driven by the driver 413*a* to reduce voltage of the Y electrode in the ramp pattern.

The two resistors R2 and R3 are connected in series between the drain of the transistor M1 and the power source VscL, and a contact of the two resistors R2 and R3 is connected with a base, a control terminal, of the transistor Q1. In some embodiments, the resistors R2 and/or R3 are variable resistors. A collector of the transistor Q1 is connected with the power source VscL, and an emitter of the transistor Q1 is connected with the gate of the transistor M1. When voltage of the Y electrode Yi reaches a certain level, the driver 413*b* turns on the transistor Q1 to cut off a path between the transistor M1 and the power source VscL.

A drain of the transistor YscL is connected with the node N, and a source of the transistor YscL is connected with the power source VscL. The transistor YscL is turned on during the address period and provides the voltage VscL to the second input terminal B of the scan circuit 414.

The sustain driver 412 is connected with the node N and applies the sustain discharge pulses having the voltage Vs to the plurality of Y electrodes Yi through the second input terminal B of the scan circuit 414, and the rising reset driver 411 is connected with the node N and applies rising reset waveforms to the Y electrodes Yi through the second input terminal B of the scan circuit 414 during the rising period of the reset period.

The operation of the falling reset/scan driver 413 as shown in FIG. 3 will now be described. First, during the reset period, the transistor Scl of the scan circuit 414 is on, so the voltage of the Y electrode Yi of the panel capacitor Cp is applied to the node N.

During the falling period of the reset period, a high level signal H is outputted from the control signal voltage source Vg. Then, the voltage of the Y electrode Y1 is gradually decreased.

As the high level signal H is outputted from the control signal voltage source Vg, the gate voltage of the transistor M1 is increased by a capacitance component formed by the capacitor C1 and a parasitic capacitor of the transistor M1 via a path formed by the resistor R1. Then, the n-channel transistor M1 is turned on, so the voltage of the Y electrode Yi is reduced through the path of the panel capacitor Cp, the transistor M1 and the power source VscL. As the voltage of the Y electrode Yi is reduced, the gate voltage of the transistor M1 is reduced by the capacitor C1 and thus the transistor M1 is turned off.

When the transistor M1 is turned off, charges accumulated in the panel capacitor Cp move to the capacitor C1, and accordingly, the gate voltage of the transistor M1 increases. Then, the transistor M1 is turned on again and the voltage of the Y electrode Yi is reduced again.

In this manner, as the transistor M1 is repeatedly turned on and off, the voltage of the Y electrode Yi gradually decreases. When the voltage of the Y electrode Yi, namely, the voltage of the node N is reduced to an arbitrary voltage Vx, the voltage Vx is divided by the two resistors R2 and R3 to obtain a base-collector voltage Vbc of the transistor Q1 as expressed by equation (1) shown below. If the base-collector voltage Vbc becomes lower than a threshold voltage Vth as expressed in equation (2), the transistor Q1 is turned on. Accordingly, because a gate-source voltage of the transistor M1 is 0V, the transistor M1 is turned off. Namely, the voltage Vx of the node N when the base-collector voltage Vbc of the transistor Q1 is substantially the same as the threshold voltage |Vth| is determined as the voltage Vnf, and the Y electrode can sustain the voltage Vnf for a certain period.

$$Vb = VscL + (Vx - VscL)\frac{R3}{(R2 + R3)} \quad (1)$$

$$Vbc = (Vx - VscL)\frac{R3}{(R2 + R3)} \leq |Vth| \quad (2)$$

The value |Vnf−VscL| can be changed by controlling resistance values of the resistor R2 and R3.

The transistor YscL is turned on during the address period. Then, the voltage VscL is applied to the Y electrodes of cells to be turned on.

Accordingly, the voltage Vnf and the voltage VscL can be applied to the y electrode Yi by using the single power source VscL.

As described above, the voltages each having a different level can be provided with the single power source, so the number of power sources of the plasma display device can be reduced.

While this invention has been described in connection with what is presently considered to be practical embodiments, it is to be understood that the invention is not limited to the disclosed embodiments, but, on the contrary, is intended to cover various modifications and equivalent arrangements.

What is claimed is:

1. A plasma display device comprising:

an electrode;

a first transistor connected between the electrode and a power source configured to supply a first voltage;

a first driver configured to change a voltage of the electrode by controlling a state of the first transistor;

a second driver configured to cut off a path between the electrode and the power source when the voltage at the electrode is a second voltage during a first period, the second voltage being different from the first voltage, wherein the voltage of the electrode is substantially sustained at the level of the second voltage; and a second transistor connected between the electrode and the power source and configured to be turned on during a second period, the second period following the first period, wherein the first voltage is applied to the electrode when the second transistor is turned on.

2. The device of claim 1, wherein the first voltage is lower than the second voltage.

3. The device of claim 2, wherein the second driver comprises:

first and second resistors connected in series between a first terminal of the first transistor and the power source; and a third transistor connected between a control terminal of the first transistor and the power source, the third transistor having a control terminal connected to the first and second resistors.

4. The device of claim 3, wherein at least one of the first and second resistors is a variable resistor.

5. The device of claim 2, wherein the first transistor is an n-channel transistor having a first terminal connected with the electrode and a second terminal connected with the power source.

6. The device of claim 2, wherein the first driver is configured to drive the first transistor such that the voltage of the electrode is gradually changed.

7. The device of claim 2, wherein the reset period comprises the first period and an address period comprises the second period, and the device is configured to apply the first voltage to selected cells of the device during the address period, the cells being selected to be turned on.

8. A plasma display device comprising:

a plurality of electrodes;

a first transistor connected between the plurality of electrodes and a power source configured to provide a first voltage;

a first driver configured to gradually decrease a voltage of the plurality of electrodes during a reset period by controlling a state of the first transistor;

first and second resistors connected in series between the plurality of electrodes and the power source, the first and second resistors having a contact therebetween;

a second transistor connected between the plurality of electrodes and the power source, the second transistor being configured to apply the first voltage to the electrodes during an address period when turned on; and a third transistor configured to be turned on in response to a voltage of the contact of the first and second resistors, and configured to turn off the first transistor when turned on.

9. The device of claim 8, wherein the first transistor is connected to the plurality of electrodes through a plurality of other elements.

10. The device of claim 8, wherein the third transistor is configured to be turned on when the voltage of the contact of the first and second resistors is below a selected value.

11. The device of claim 8, wherein the first transistor is an NMOS transistor having a drain connected to the electrodes and a source connected to the power source, and the third transistor is a pnp-type transistor having an emitter connected with a control terminal of the first transistor and a collector connected to the power source.

12. The device of claim 11, further comprising:

a plurality of scan circuits, each scan circuit connected to one of the plurality of electrodes, and configured to selectively apply a voltage provided to a first terminal of the scan circuit and a voltage provided to a second terminal of the scan circuit to the electrodes, wherein the first voltage is provided to each second terminal of the plurality of scan circuits during the address period.

13. The device of claim 12, wherein each second terminal of the plurality of scan circuits is connected to the first transistor and the second transistor.

14. The device of claim 8, wherein at least one of the first and second resistors is a variable resistor.

* * * * *